US007894736B2

(12) United States Patent
Nakamura

(10) Patent No.: US 7,894,736 B2
(45) Date of Patent: Feb. 22, 2011

(54) IMAGE FORMING APPARATUS INCLUDING CONTROL FOR MAIN AND AUXILIARY HEATING MEMBERS

(75) Inventor: Kei Nakamura, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 544 days.

(21) Appl. No.: 11/979,589

(22) Filed: Nov. 6, 2007

(65) Prior Publication Data

US 2008/0212991 A1 Sep. 4, 2008

(30) Foreign Application Priority Data

Nov. 7, 2006 (JP) ..... 2006-301637

(51) Int. Cl.
*G03G 15/20* (2006.01)
*G03G 15/00* (2006.01)

(52) U.S. Cl. ..... 399/70; 399/384

(58) Field of Classification Search ..... 399/69, 399/70, 384
See application file for complete search history.

(56) References Cited

U.S. PATENT DOCUMENTS

| | | | | |
|---|---|---|---|---|
| 6,542,705 | B2 | 4/2003 | Fujita et al. | |
| 6,987,936 | B2 | 1/2006 | Satoh et al. | |
| 2004/0228644 | A1 * | 11/2004 | Kikuchi | 399/69 |
| 2005/0276642 | A1 * | 12/2005 | Ohki et al. | 399/384 |
| 2006/0091130 | A1 * | 5/2006 | Kishi et al. | 219/482 |
| 2007/0047989 | A1 | 3/2007 | Nakamura et al. | |

FOREIGN PATENT DOCUMENTS

| | | |
|---|---|---|
| JP | 8-220928 | 8/1996 |
| JP | 11-065362 | 3/1999 |
| JP | 2002-184554 | 6/2002 |
| JP | 2003-297526 | 10/2003 |
| JP | 2004-226461 | 8/2004 |
| JP | 2005-032558 | 2/2005 |
| JP | 2005-039873 | 2/2005 |
| JP | 2005-166633 | 6/2005 |
| JP | 2005-174577 | 6/2005 |
| JP | 2005-235652 | 9/2005 |

* cited by examiner

*Primary Examiner*—David M Gray
*Assistant Examiner*—Joseph S Wong
(74) *Attorney, Agent, or Firm*—Harness, Dickey & Pierce, P.L.C.

(57) ABSTRACT

An image forming apparatus which causes a long recording medium carrying a toner image thereon to pass between a fixing roller and a pressure roller to fix the toner image onto the long recording medium by means of the action of heat and pressure. The temperature of the fixing roller is prevented from being significantly reduced during operation of fixing the toner image, and thereby the occurrence of a toner image fixation failure is prevented. When the temperature of the fixing roller is reduced, in addition to a main heating member of heating means, electric power is also supplied from an auxiliary power source to an auxiliary heating member to cause the auxiliary heating member to generate heat. Furthermore, before print operation is started, it is determined, from the temperature of the fixing roller and the pressure roller and the remaining amount of electric power supplied from the auxiliary power source, whether the toner image can be fixed or not over the entire length of the long recording medium, and the print operation is started only when the toner image can be fixed.

10 Claims, 7 Drawing Sheets

IMAGE FORMING APPARATUS INCLUDING CONTROL FOR MAIN AND AUXILIARY HEATING MEMBERS

BACKGROUND OF THE INVENTION

1. Field of the Invention

The present invention relates to an image forming apparatus that forms a toner image on an image carrier, transfers the toner image to a long recording medium longer than a regular size, and fixes the toner image transferred to the long recording medium to the long recording medium by means of a fixing device.

2. Description of the Related Art

According to the above form of image forming apparatus that is configured as an electronic copying machine, a printer, a facsimile device or a complex machine thereof, an image can be formed on a long recording medium of, for example, 10 through 15 meters. A fixing device used in such an image forming apparatus has a fixing member, a pressure member pressure-contacted with the fixing member, first temperature detecting means for detecting the temperature of the fixing member, second temperature detecting means for detecting the temperature of the pressuring member, and heating means for heating the fixing member, wherein a long recording medium carrying a toner image is caused to pass through a nip portion formed between the fixing member and the pressure member, and heat and pressure are applied to a toner of the toner image on the long recording medium so that the toner image is fixed to the long recording medium.

In such a fixing device, by causing the long recording medium to pass between the fixing member and the pressure member, the heat of the fixing member is constantly lost to the long recording medium over a long period of time, whereby the temperature of the fixing member becomes lower than a temperature appropriate for fixing a toner image, while the long recording medium passes between the fixing member and the pressure member, causing a toner image fixation failure.

Therefore, it is necessary to use a fixing member having a large heat capacity in order to prevent the temperature of the fixing member from becoming lower than the temperature appropriate for fixing a toner image, when the long recording medium passes between the fixing member and the pressure member. However, the inevitable problem is that, if such a fixing member having a large capacity is used, the start-up time in which the temperature of the fixing member increases to the temperature appropriate for fixing a toner image becomes long when the start-up operation of the fixing device is performed.

Note that a general configuration of a fixing device used in an image forming apparatus is described in, for example, Japanese Unexamined Patent Application Publication No. 2002-184554, Japanese Unexamined Patent Application Publication No. 2005-39873, Japanese Unexamined Patent Application Publication No. 2005-32558, and Japanese Unexamined Patent Application Publication No. 2005-18049.

SUMMARY OF THE INVENTION

It is an object of the present invention to provide an image forming apparatus that reduces, without using a fixing member having a particularly large heat capacity, the temperature of a fixing member to a temperature lower than that appropriate for fixing a toner image, during an operation of fixing a toner image onto a long recording medium, to thereby prevent the occurrence of a toner image fixation failure.

In an aspect of the present invention, an image forming apparatus forms a toner image on an image carrier, transfers the toner image to a long recording medium longer than a regular size, and fixes the toner image transferred to the long recording medium to the long recording medium by means of a fixing device. The fixing device comprises a fixing member; a pressure member pressure-contacted with the fixing member; a first temperature detecting device, for detecting a temperature of the fixing member; and a heating device for heating the fixing member, causes the long recording medium carrying the toner image thereon to pass through a nip portion formed between the fixing member and the pressure member, and applies, at the time of the passage, heat and pressure to a toner of the toner image to fix the toner image onto the long recording medium. The heating device has a main heating member to which electric power is supplied from a main power source; and an auxiliary heating member to which electric power is supplied from an auxiliary power source. When fixing the toner image by causing the long recording medium to pass between the fixing member and the pressure member while heating the fixing member by means of only the main heating member to which electric power is supplied from the main power source, if the temperature of the fixing member that is detected by the first temperature detecting device is equal to or lower than a predetermined fixation temperature threshold at which it is determined that a temperature required for toner image fixation cannot be maintained, the electric power is supplied from the auxiliary power source to the auxiliary heating member to heat the fixing member by means of the auxiliary heating member as well.

In another aspect of the present invention, an image forming method forms a toner image on an image carrier, transfers the toner image to a long recording medium longer than a regular size, and fixes the toner image transferred to the long recording medium to the long recording medium. The method comprises a step of preparing a fixing device that comprises a fixing member, a pressure member pressure-contacted with the fixing member, a first temperature detecting device for detecting a temperature of the fixing member, a main heating member to which electric power is supplied from a main power source, an auxiliary heating member to which electric power is supplied from an auxiliary power source, and a heating device for heating the fixing member; a step of causing the long recording medium carrying the toner image thereon to pass through a nip portion formed between the fixing member and the pressure member, and applying, at the time of the passage, heat and pressure to a toner of the toner image to fix the toner image onto the long recording medium; and a step of supplying the electric power from the auxiliary power source to the auxiliary heating member to heat the fixing member by means of the auxiliary heating member as well. When fixing the toner image by causing the long recording medium to pass between the fixing member and the pressure member while heating the fixing member by means of only the main heating member to which electric power is supplied from the main power source, if the temperature of the fixing member that is detected by the first temperature detecting device is equal to or lower than a predetermined fixation temperature threshold at which it is determined that a temperature required for toner image fixation cannot be maintained.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

An embodiment of the present invention will be described hereinafter in detail with reference to the drawings.

Figure 1:
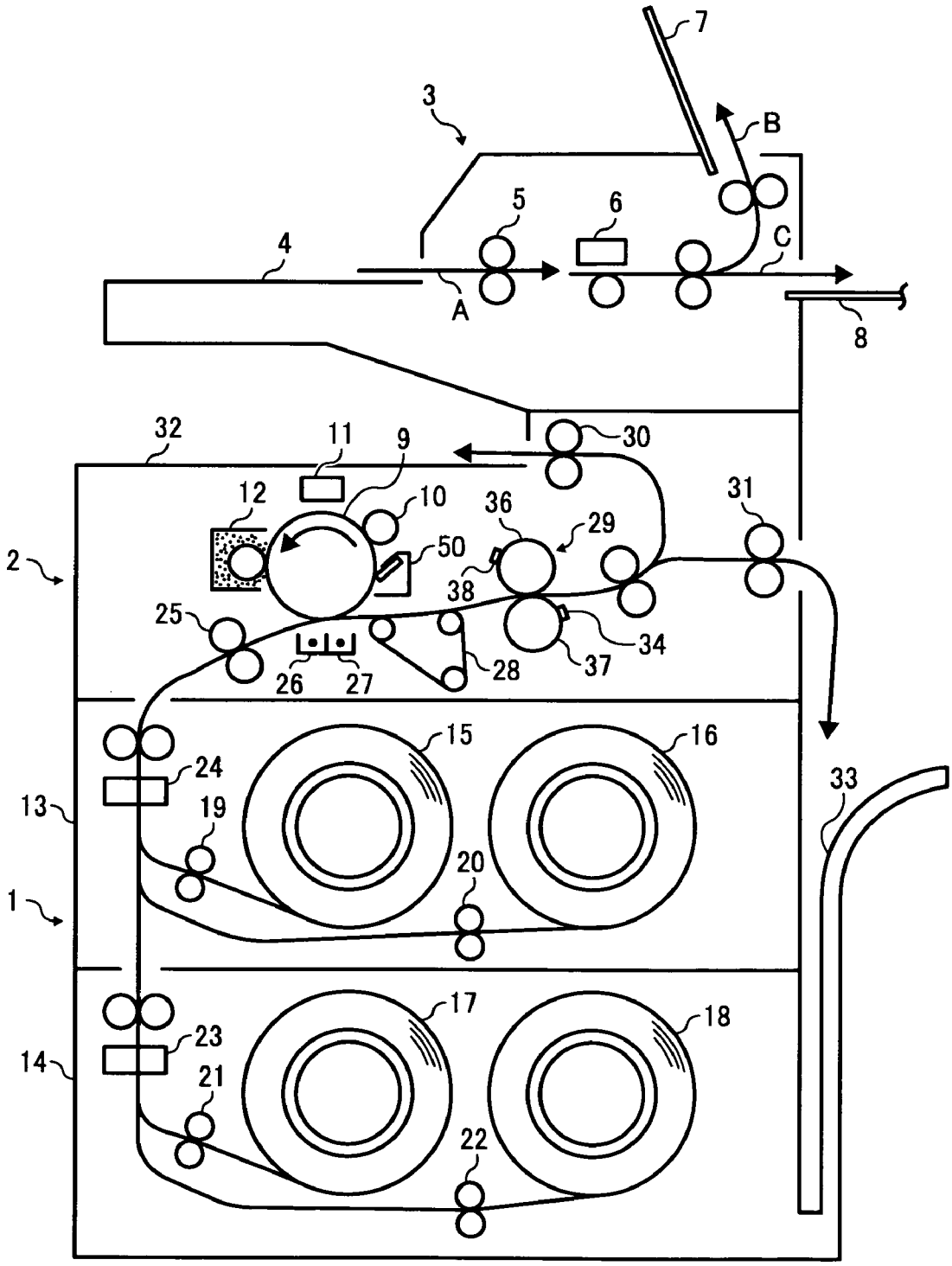
FIG. 1 is a view showing the entire schematic configuration of an image forming apparatus according to an embodiment of the present invention.

An image forming apparatus shown in FIG. 1 has a sheet feeding portion 1, an image creating portion 2 disposed on the sheet feeding portion 1, and an image reading portion 3 disposed on the image creating portion 2. A side fence, not shown, aligns the position of an original, not shown, in a width direction, the original being placed on an original table 4 of the image reading portion 3. The original is then fed in the direction of an arrow A by a sheet feeding roller 5 and passes beneath a close contact type reading device 6. An original width detection sensor and an original length detection sensor, not shown, are provided on the original table 4, and the size of the original is detected by these sensors. The close contact type reading device 6 has a rod lens array and an image sensor, which are not shown. When the original passes beneath the close contact type reading device 6, the original is irradiated with light emitted from a light source such as an LED array and fluorescent light, and the reflected light reaches the image sensor via the rod lens, whereby an image on the original is formed and photoelectrically converted by the image sensor. The original that has been subjected to image reading is discharged to a discharge tray 7 or 8 as shown by an arrow B or C. Furthermore, the image reading portion 3 is provided with a display operating portion (not shown) to which are input an instruction for starting a print operation, the number of repeat copies, and information such as the length of a sheet, and to which various information items are displayed.

The image creating portion 2 has a drum-shaped photoreceptor 9, which is an example of an image carrier, and this photoreceptor 9 is driven to rotate in a counter-clockwise direction of FIG. 1, and charged by a charging device 10 at this moment. On the other hand, a signal of the image read by the close contact type reading device 6 is subjected to image processing. Light corresponding to the image signal is emitted from an exposure device 11 provided with the LED array, and this light illuminates the surface of the charged photoreceptor. Accordingly, an electrostatic latent image is formed on the photoreceptor 9, and this latent image is made visible as a toner image by a developing device 12.

On the other hand, the sheet feeding portion 1 has top and bottom roll paper trays 13, 14 configured in two stages. Roll papers 15, 16, 17, 18 that are wrapped around paper cores respectively are supported rotatably by the roll paper trays 13, 14, and sheet feeding rollers 19, 20, 21, 22 corresponding to the roll papers respectively are disposed on the roll paper trays 13, 14. Each of the roll paper trays 13, 14 can be pulled out from an apparatus housing toward the left of FIG. 1, and a roll paper can be set or a jam can be processed while the roll paper tray is being pulled out. A sheet is reeled out from any selected roll paper 15, 16, 17 or 18 by the corresponding sheet feeding roller 19, 20, 21 or 22, and this sheet is sent to the image creating portion 2. The sheet is cut into a predetermined length by a cutter unit 23 or 24. This sheet is fed to the photoreceptor 9 by a resist roller pair 25 at a predetermined timing, whereupon the toner image that is formed on the photoreceptor 9 is transferred to the sheet by the action of a transfer device 26. Next, the sheet is separated from the photoreceptor 9 by the action of a separation device 27 and thereafter conveyed to a fixing device 29 by a conveyance belt 28. Transfer residual toner that remains adhered to the surface of the photoreceptor 9 after the toner image is transferred is removed by a cleaning device 50. The transferred toner image is fixed to the sheet as the sheet passes through the fixing device 29. A discharge roller 30 or 31 discharges the sheet, which has passed through the fixing device 29, to a discharge portion 32 configured by an upper surface of the image creating portion 2 or a discharge portion 33 disposed behind the image creating portion 2.

The image forming apparatus shown in FIG. 1 forms an image on the sheets reeled out from the roll papers 15 through 18 and cut, and hence can select the length of each sheet substantially freely. Therefore, the length of each sheet can be made greater than the length of a regular size, such as 15 meters. A recording medium other than paper can be used as such a long recording medium. In the following description, a long recording medium or paper that is reeled out from a roll paper and then cut by the cutter unit 23 or 24 or that is already cut by the cutter unit 23 or 24 is referred to as a long recording medium P (see FIG. 2). The image forming apparatus shown in the drawing can form an image on the long recording medium P and, of course, on a short recoding medium.

The image forming apparatus shown in FIG. 1 is configured such that a toner image is formed on an image carrier constituted as the photoreceptor 9, the toner image is transferred to the long recording medium longer than the regular size, and the toner image transferred onto the long recording medium is fixed onto the long recording medium by the fixing device 29. However, a configuration is possible in which the toner image formed on the photoreceptor is subjected to primary transfer onto an intermediate transfer body, and the toner image transferred onto the intermediate transfer body is subjected to secondary transfer onto the long recording medium. In this case, the intermediate transfer body configures the image carrier, and the toner image formed on such image carrier is transferred onto the long recording medium.

Figure 2:
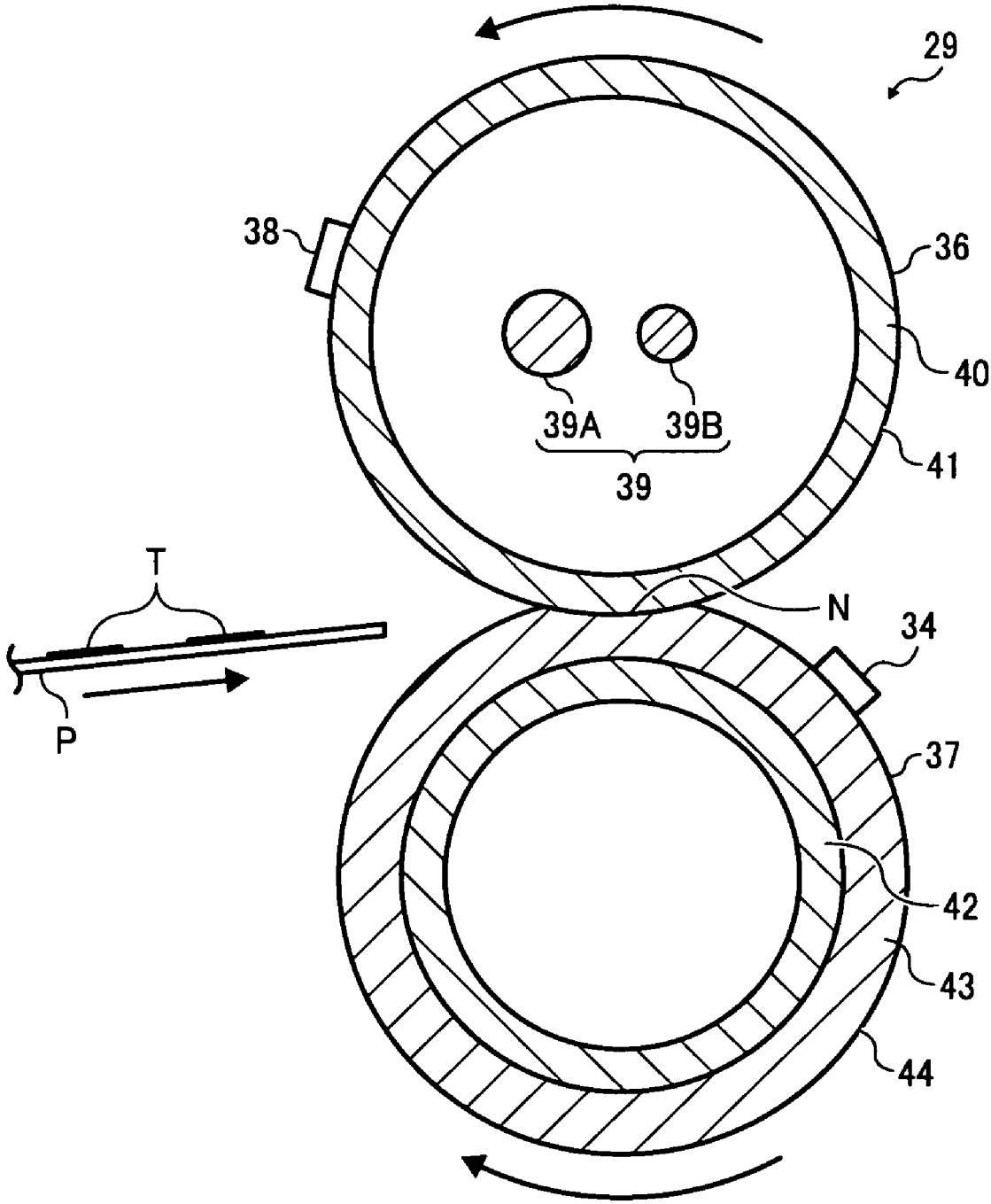
FIG. 2 is a cross-sectional view showing a configuration of a fixing device of the image forming apparatus.

FIG. 2 shows a cross section of the fixing device 29 shown in FIG. 1. The fixing device 29 shown in this drawing has a fixing roller 36, which is an example of a fixing member, a pressure roller 37, which is an example of a pressure member pressure-contacted with the fixing roller 36, first temperature detecting means 38 for detecting the temperature of a surface of the fixing roller 36, second temperature detecting means 34 for detecting the temperature of a surface of the pressure roller 37, and heating means 39 for heating the fixing roller 36.

The fixing roller 36 shown in FIG. 2 is constituted by a cylindrical metallic tube 40 made of aluminum, carbon steel or the like, and a mold-releasing layer 41 laminated on an outer peripheral surface of the metallic tube 40. The pressure roller 37 is constituted by a cylindrical cored bar 42 made of metal such as aluminum or carbon steel, an elastic layer 43 made of silicone rubber, which is fixed to an outer peripheral surface of the cored bar, and a mold-releasing layer 44 laminated on an outer peripheral surface of the elastic layer 43. The first temperature detecting means 38 is configured by, for example, a thermistor abutting against a peripheral surface of the fixing roller 36, or other temperature sensor.

Moreover, the heating means 39 shown in FIG. 2 has a main heating member 39A that is supplied with electric power from a main power source, which is described hereinafter in detail, to thereby generate heat, and an auxiliary heating member 39B supplied with electric power from an auxiliary power source to thereby generate heat. These heating members 39A, 39B are disposed within the fixing roller 36. A halogen heater, a nichrome wire heater, an IH heater or the like, for example, can be used as the heating members 39A, 39B. Heating means for heating the outside of the fixing roller 36 can also be used. No heater is provided within the pressure roller 37.

A driving device, not shown, drives to rotate the fixing roller 36 in a counter-clockwise direction of FIG. 2 when an operation of fixing a toner image is performed, and the pressure roller 37 is driven by the rotation of the fixing roller 36 to rotate in a clockwise direction of FIG. 2. At this moment, the fixing roller 36 is heated by the heating means 39, the long recording medium P carrying a toner image T thereon is caused to pass through a nip portion N formed between the fixing roller 36 and the pressure roller 37 such that the toner image T is oriented to abut against the fixing roller 36, and, at the time of this passage, heat and pressure are added to a toner of the toner image T to fix the toner image onto the long recording medium P.

In the fixing device 29 shown in FIG. 2, when the long recording medium P passes between the fixing roller 36 and the pressure roller 37 the heat of the fixing roller 36 is constantly lost to the long recording medium P over a long period of time. For this reason, the temperature of the surface of the fixing roller 36 might become lower than the temperature suitable for fixation, while the long recording medium P passes between the fixing roller 36 and the pressure roller 37.

Therefore, in the image forming apparatus of the present embodiment, as described above, the heating means 39 provided in the fixing device 29 has the main heating member 39A to which electric power is supplied from the main power source constituted by an AC power source, and the auxiliary heating member 39B to which electric power is supplied from the auxiliary power source. Moreover, the image forming apparatus of the present embodiment is configured such that when the temperature of the surface of the fixing roller 39 is set to a fixation temperature threshold $T_{lim}$ (150° C., for example) at which it is determined that the temperature required for fixing the toner image cannot be maintained at this surface temperature, if the surface temperature $T_H$ of the fixing roller 36 that is detected by the first temperature detecting means 38 is higher than the fixation temperature threshold $T_{lim}$, the fixing roller 36 is heated only by the main heating member 39A supplied with electric power from the main power source to thereby generate heat, but if the surface temperature $T_H$ of the fixing roller 36 that is detected by the first temperature detecting means 38 is equal to or lower than the fixation temperature threshold $T_{lim}$, electric power is supplied from the auxiliary power source to the auxiliary heating member 39B as well to heat the auxiliary heating member 39B, whereby the fixing roller 36 is promptly heated by both the main heating member 39A and the auxiliary heating member 39B.

An electric double layer capacitor capable of being charged and discharged, or a fuel cell that can be repeatedly used by replacing fuel can be used as the auxiliary power source.

As described above, the image forming apparatus of the present embodiment is configured such that when the long recording paper P is caused to pass between the fixing roller 36 and the pressure roller 37 to fix the toner image while heating the fixing roller 36 by means of only the main heating member 39A supplied with electric power from the main power source, if the surface temperature $T_H$ of the fixing roller 36 that is detected by the first temperature detecting means 38 becomes equal to or lower than the predetermined fixation temperature threshold $T_{lim}$ at which it is determined that the temperature required for toner image fixation cannot be maintained, electric power is supplied from the auxiliary power source to the heating member 39B to heat the fixing roller 36 by means of the auxiliary heating member 39B. According to this configuration, when the temperature of the fixing roller 36 decreases, electric power is supplied from the auxiliary power source to the auxiliary heating member 39B as well to heat the fixing roller 36. Therefore, even if a significant amount of heat of the fixing roller 36 is lost to the long recording medium due to the length of the recording medium, the occurrence of a toner image fixation failure can be prevented.

Incidentally, in the case in which an electric double layer capacitor is used as the auxiliary power source, the electric double layer capacitor is charged when electric power is not supplied from the main power source to the main heating member 39A. For example, the main heating member 39A is caused to generate heat by conducting the main heating member 39A to thereby heat the fixing roller 36, and the temperature of the fixing roller 36 is increased to a predetermined temperature to start up the fixing device, and thereafter supply of electric power from the main power source to the main heating member 39A is subjected to ON/OFF control so that the temperature of the fixing roller 36 is kept at the predetermined temperature at a waiting time for waiting for the fixation operation to start. At this moment, electric power is not supplied from the auxiliary power source to the auxiliary heating member 39B. In this manner, the waiting time of the fixing device 29 has a time at which electric power is supplied from the main power source to the main heating member 39A and a time at which electric power is not supplied. Therefore, a charging voltage of the electric double layer capacitor is detected by a voltage sensor, not shown, which is an example of means for detecting the voltage of the electric double layer capacitor configuring the auxiliary power source. In the case in which there is room for charging the electric double layer capacitor, the electric double layer capacitor is charged when electric power is not supplied from the main power source to the main heating member 39A as described above. Accordingly, the electric double layer capacitor can be charged efficiently, and the electric power consumed when the electric double layer capacitor is used can be secured significantly.

Next is described a specific configuration example related to supply of electric power to the auxiliary power source.

Figure 3:
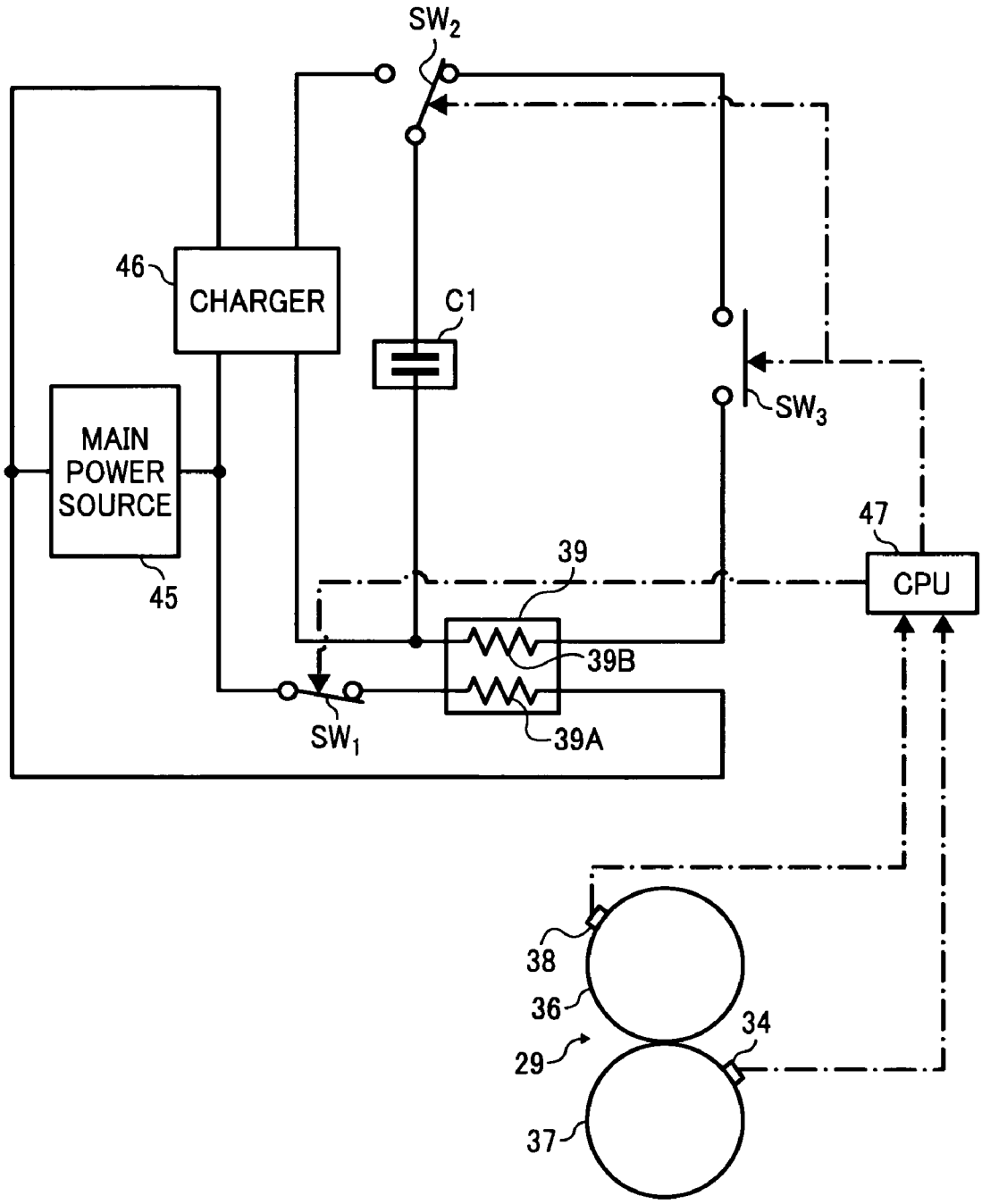
FIGS. 3 through 6 each are a circuit diagram of a main power source, an auxiliary power source, and the fixing device.
Figure 4:
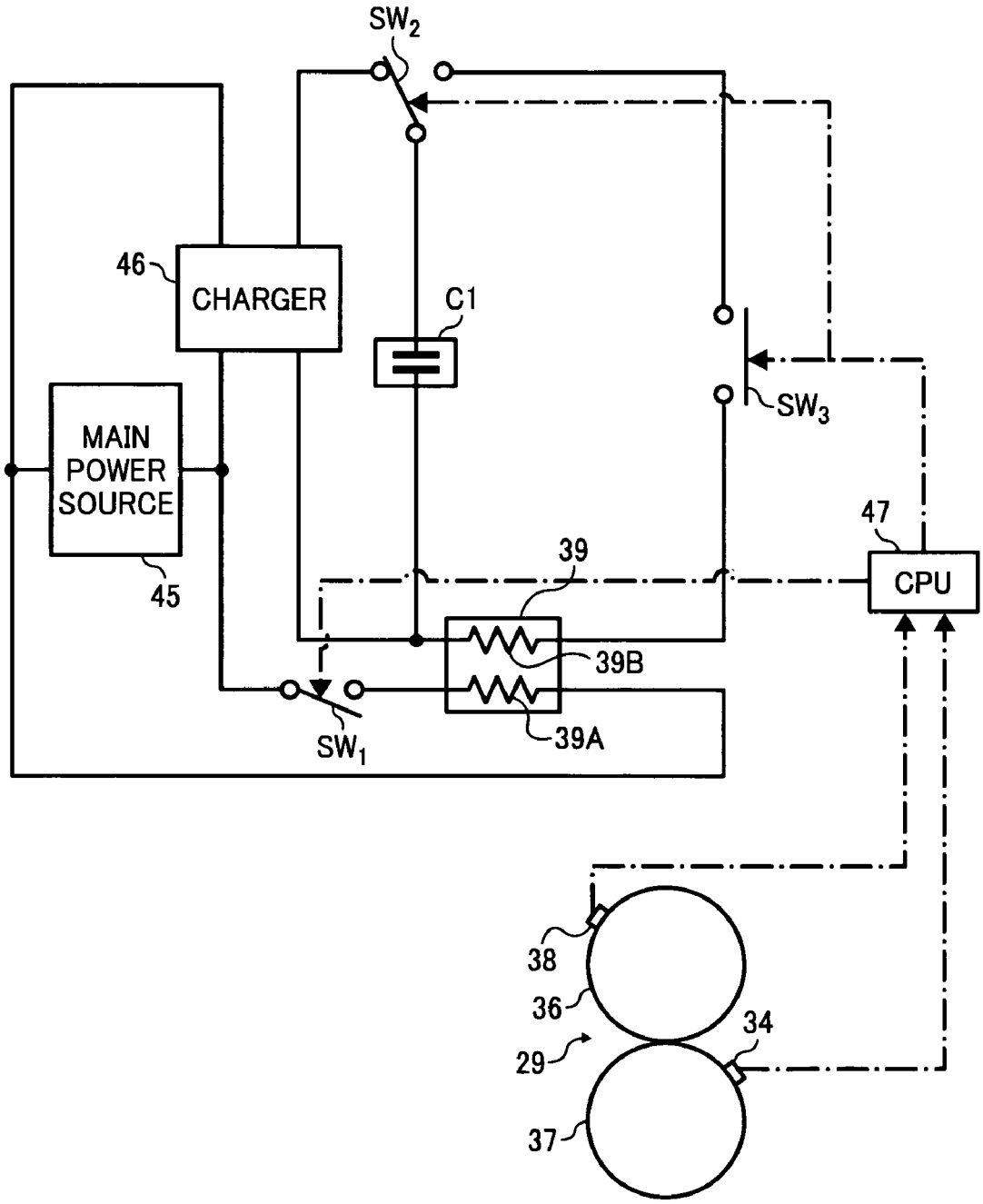
Figure 5:
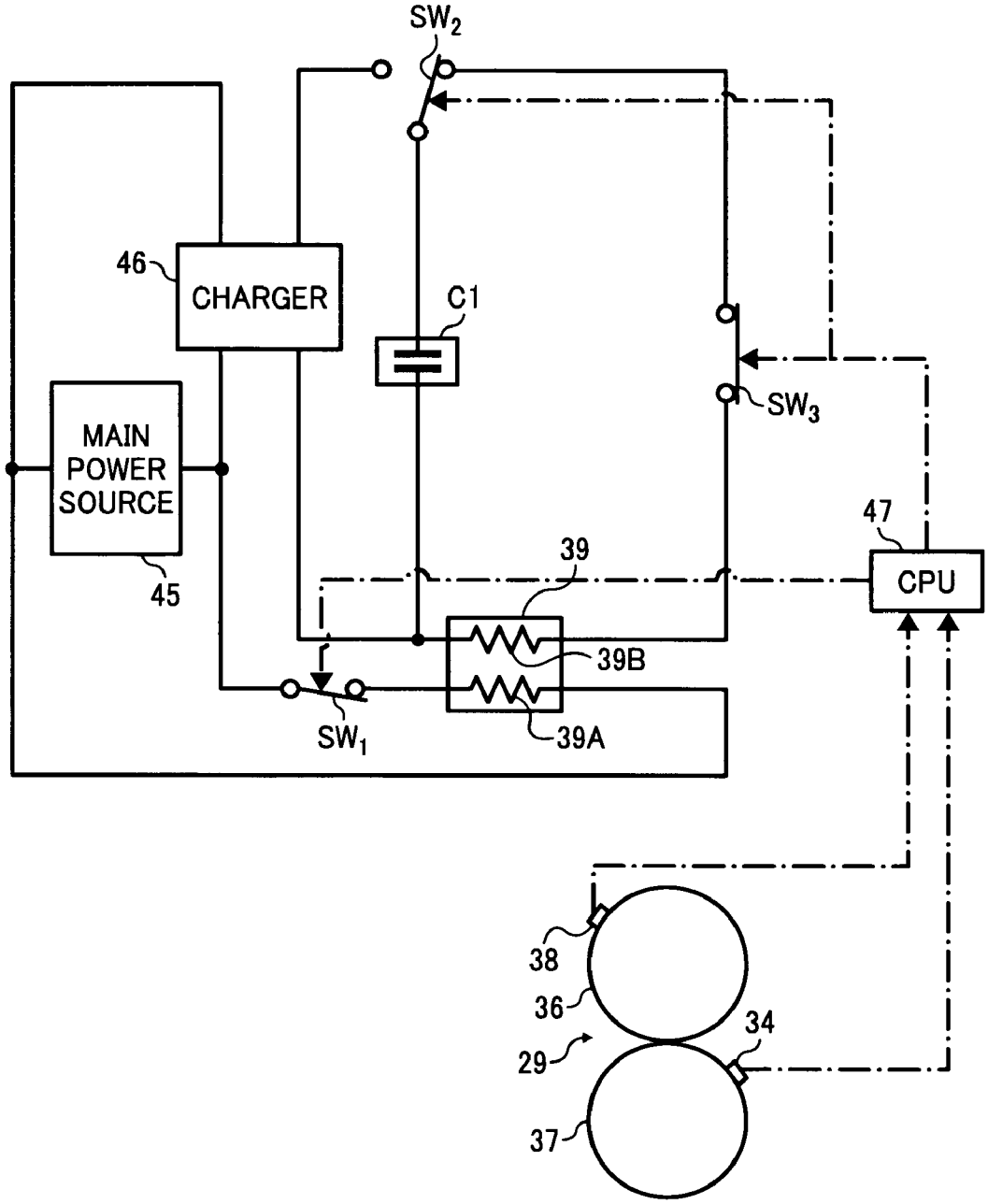

FIG. 3 through FIG. 5 each show an example of a circuit diagram for supplying electric power from an electric double layer capacitor C1 to the auxiliary heating member 39B. The electric double layer capacitor C1 is configured by a plurality of capacitor cells. A main switch $SW_1$ switches ON or OFF an electric power supplied from the main power source 45 constituted by an AC power source to the main heating member 39A. A charger 46 serves to charge the electric double layer capacitor C1 by means of the electric power supplied from the main power source 45. Furthermore, a switch $SW_2$ charges the electric double layer capacitor C1 and switches electric power supply between the electric double layer capacitor C1 and the auxiliary heating member 39B. A detection signal that is generated by the first temperature detecting means 38 configured by a thermistor or the like abutting against the surface of the fixing roller 36 is loaded to a CPU 47, and the switches $SW_1$ through $SW_3$ are subjected to switching control by an instruction sent from the CPU 47.

FIG. 3 shows a state in which the main switch $SW_1$ is closed and electric power is supplied from the main power source 45 to the main heating member 39A to heat the main heating member 39A. At this moment the switch $SW_2$ is switched to the switch $SW_3$ side, but since the switch $SW_3$ is OFF, the electric power of the electric double layer capacitor C1 is not supplied to the auxiliary heating member 39B.

When charging the electric double layer capacitor C1, the main switch $SW_1$ is switched OFF and supply of electric power from the main power source 45 to the main heating member 39A is blocked, as shown in FIG. 4. At the same time the switch $SW_2$ is switched to the charger 46 side, whereby the charger 46 charges the electric double layer capacitor C1 by means of the electric power supplied from the main power source 45.

When the surface temperature $T_H$ of the fixing roller 36 that is detected by the first temperature detecting means 38 becomes equal to or lower than the fixation temperature threshold $T_{lim}$ when the operation of fixing the toner image is performed while heating the fixing roller 36 by means of the main heating member 39A only, the main switch $SW_1$ is switched ON as shown in FIG. 5 so that electric power is supplied from the main power source 45 to the main heating member 39A, and at the same time the switch $SW_2$ is switched to the switch $SW_3$ side and the switch $SW_3$ is closed. Accordingly, electric power is supplied from the main power source 45 to the main heating member 39A, and electric power is supplied from the electric double layer capacitor C1 to the auxiliary heating member 39B, whereby both heating members 39A, 39B generate heat.

Figure 6:
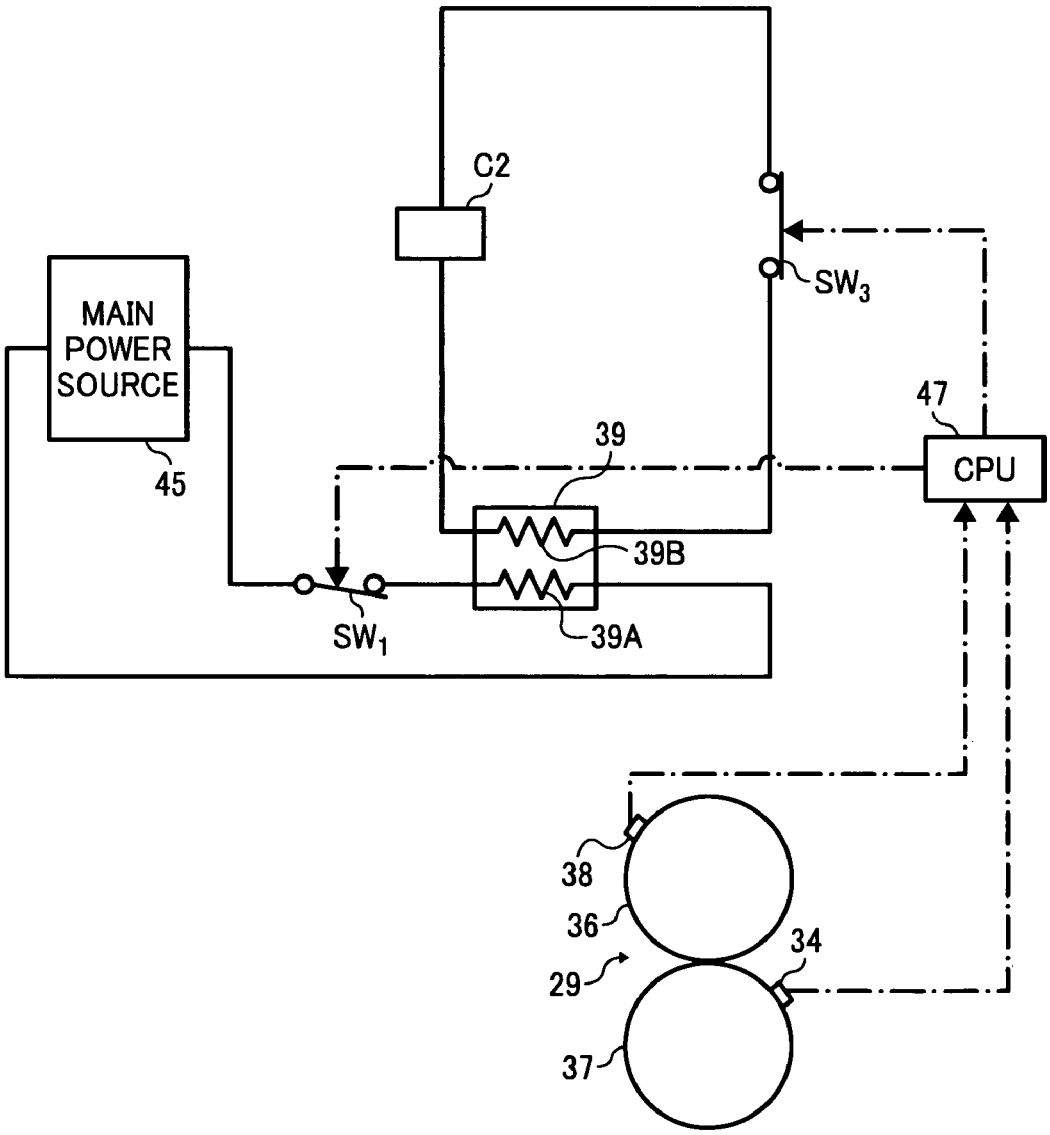

FIG. 6 is a circuit diagram showing a state in which a fuel cell C2 is used as the auxiliary power source. In this case, the charger 46 shown in FIG. 3 through FIG. 5 is not provided. FIG. 6 shows a state in which the switches $SW_1$ and $SW_3$ are closed and electric power is supplied from the fuel cell C2 and the main power source 45 to the auxiliary heating member 39B and the main heating member 39A respectively. When the electric power of the main power source 45 is supplied to the main heating member 39A but the electric power of the fuel cell C2 is not supplied to the auxiliary heating member 39B, the switch $SW_3$ is opened.

Since a fuel cell loses its power as it discharges electricity, it is necessary to constantly monitor the remaining amount of fuel, display the remaining amount of fuel to a display operating portion, and notify a user of this remaining amount. It is preferred that the energy of the fuel cell be configured to be replaceable as with a cartridge type fuel cell so that it can be replaced when the user recognizes that the fuel is low. In this manner, it is preferred that the fuel cell have means for detecting the remaining amount of fuel, means for displaying the remaining amount of fuel, and means for prompting replacement of the fuel cell when the remaining amount of fuel falls below a certain value.

Incidentally, the image forming apparatus of the present embodiment can prevent the occurrence of a fixation failure of the toner image carried on the recording medium even if the length of the recording medium is long, as described above. However, in the case in which the surface temperature of the fixing roller is relatively low when fixation of the toner image on the long recording medium is started, or in the case in which the temperature of the pressure roller 37 is not as high as that obtained immediately after completion of warm-up of the fixing device, and thereby the amount of heat accumulated in the pressure roller 37 is low, or in the case in which the remaining amount of electric power that can be supplied from the auxiliary power source to the auxiliary heating member 39B is low, there is a risk that the surface temperature of the fixing roller 36 becomes lower than the temperature suitable for fixing the toner image when the long recording medium is caused to pass between the fixing roller 36 and the pressure roller 37 to perform toner image fixation, causing a toner image fixation failure.

Therefore, if a toner image fixation failure occurs while the long recording medium is conveyed through the space between the fixing roller 36 and the pressure roller 37, the entire long recording medium that has been subjected to fixation processing might have to be discarded, causing tremendous economical loss.

Therefore, the image forming apparatus of the present embodiment has, in addition to the configuration described above, a configuration in which the temperature of the fixing roller 36 and the pressure roller 37 and the condition of the auxiliary power source are detected prior to the start of print operation, a determination is made as to whether it is possible to fix a toner image over the entire length of a long recording medium to be used in the print operation that is about to be started, the print operation is started only if toner image fixation is possible, the fixing roller 36 is further heated to increase the surface temperature thereof if the toner image fixation is not possible, and a state in which the toner image can be fixed over the entire length of the long recording medium is ensured to start the print operation. Hereinafter, a specific example of this configuration is described with reference to FIG. 7.

Figure 7:
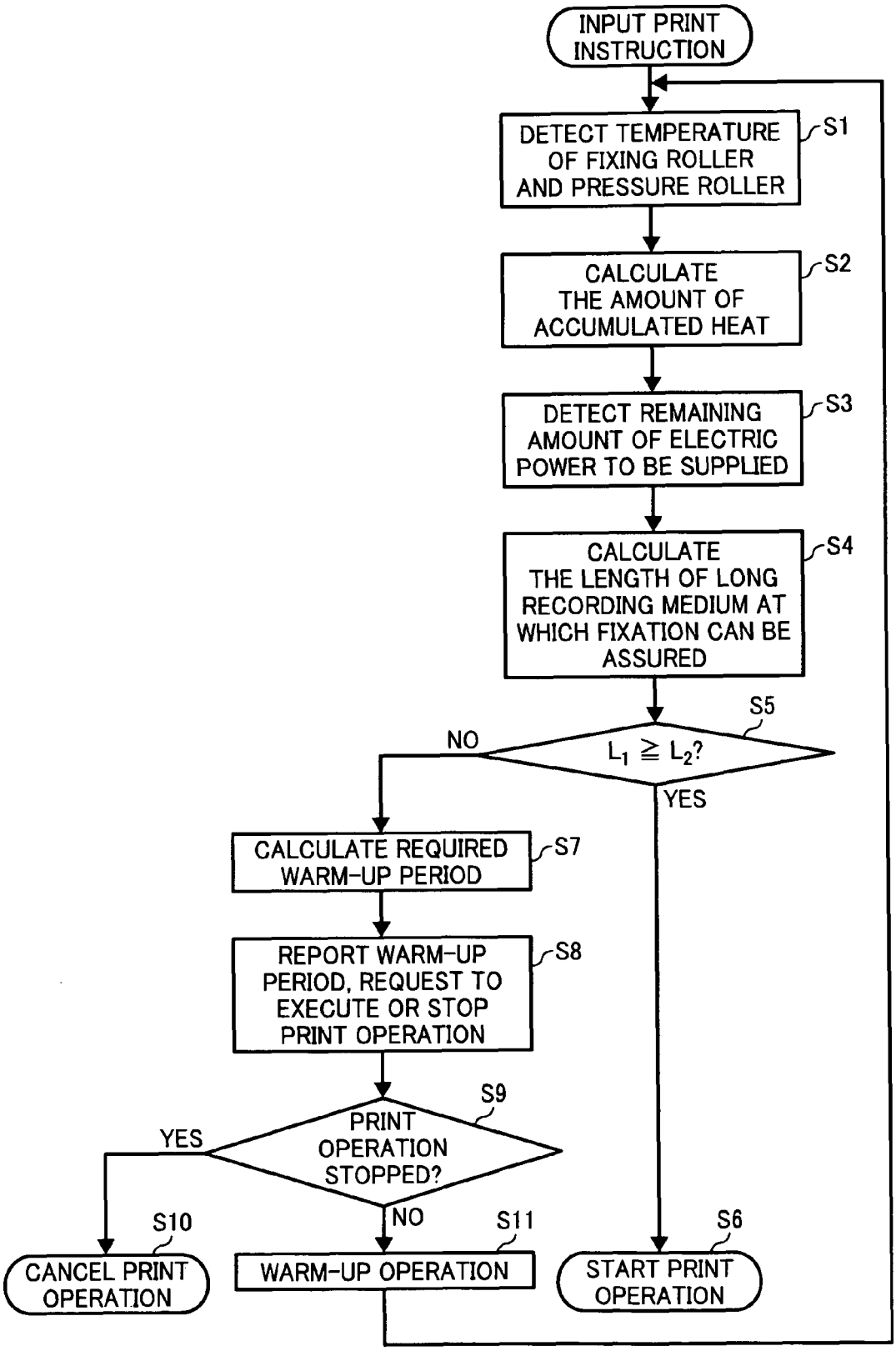
FIG. 7 is a flow diagram showing a form of an operation of the image forming apparatus.

In FIG. 7, once a print instruction is input, first the surface temperature of the fixing roller 36 and the surface temperature of the pressure roller 37 are detected by the first temperature detecting means 38 and the second temperature detecting means 34 shown in FIG. 2, respectively (S1 of FIG. 7), and the amount of heat accumulated in the fixing roller 36 and the pressure roller 37 is calculated from the detected temperature (S2 of FIG. 7). The heat capacity of the fixing roller 36 and the pressure roller 37 is obtained beforehand, thus the amount of heat accumulated in the fixing roller 36 and the pressure roller 37 is estimated and calculated from the previously obtained heat capacity and the surface temperature of the fixing roller 36 and the pressure roller 37. In this manner, the image forming apparatus of the present embodiment has means for calculating the amount of heat accumulated in the fixing roller 36 and the pressure roller 37 from the temperature of the fixing roller 36 and the pressure roller 37 that is detected by the first and second temperature detecting means.

Next, the remaining amount of electric power that can be supplied from the auxiliary power source to the auxiliary heating member 39B is detected in S3 of FIG. 7. When an electric double layer capacitor capable of being charged and discharged is used as the auxiliary power source, the total remaining amount of electric power that can be supplied from the auxiliary power source to the auxiliary heating member 39B can be detected by detecting the voltage of the electric double layer capacitor by means of the abovementioned voltage sensor. Moreover, when a fuel cell is used as the auxiliary power source, the total remaining amount of electric power that can be supplied from the auxiliary power source to the auxiliary heating member 39B can be detected by detecting the remaining amount of fuel by using the abovementioned means for detecting the remaining amount of fuel. In this manner, the image forming apparatus of the present embodiment has remaining amount detecting means for detecting the remaining amount of electric power supplied from the auxiliary power source, wherein when the auxiliary power source is the electric double layer capacitor the remaining amount detecting means is configured by the means for detecting the voltage of the electric double layer capacitor, and when the auxiliary power source is a fuel cell the remaining amount detecting means is configured by the means for detecting the remaining amount of fuel.

Furthermore, in S4 of FIG. 7, the length of the long recording medium onto which the toner image can be fixed is calculated from the abovementioned remaining amount of electric power supplied from the auxiliary power source and the amount of heat accumulated in the fixing roller 36 and the pressure roller 37. The length of the toner image to be fixed, which corresponds to the length of the long recording medium, is calculated by means of the amount of heat that the fixing roller 36 and the pressure roller 37 each posses currently and the amount of available electric power that remains in the auxiliary power source. In this manner, the image forming apparatus of the present embodiment has means for using the remaining amount of electric power supplied from the auxiliary power source, which is detected by the abovementioned remaining amount detecting means, and the amount of accumulated heat of the fixing roller 36 and the pressure roller 37 to calculate the length of the recording medium that can assure fixation of the toner image onto the long recording medium.

Next, in S5 of FIG. 7, a length $L_1$ of the long recording medium that can assure fixation of the toner image is compared with a length $L_2$ of the long recording medium that is used in print operation, and only if the length $L_1$ is equal to or greater than the length $L_2$, the print operation described above with reference to FIG. 1 is started (S6 of FIG. 7). When a print instruction is input, since the length $L_2$ of the long recording medium, which is used in the print operation, is already known, the length $L_2$ of the long recording medium is compared with the length $L_1$ of the long recording medium at which the toner image can be fixed, the length $L_1$ being calculated in S4. If $L_1 \geqq L_2$, that is, only if the toner image can be fixed on a single long recording medium in the input print operation by means of the current amount of accumulated heat of the fixing roller 36 and the pressure roller 37 and the remaining amount of electric power supplied from the auxiliary power source, the print operation is started. Accordingly, after the print operation is started, the problem such as the occurrence of a toner image fixation failure due to the temperature of the fixing roller 36 lower than the temperature suitable fixation can be prevented.

As described above, the image forming apparatus of the present embodiment has means for comparing the length of the long recording medium that is used in print operation when a print instruction is input, with the length of the recording medium that can assure fixation of the toner image at the time of the print operation, and control means for starting the print operation only when the length of the recording medium that can assure fixation of the toner image is equal to or greater than the length of the long recording medium that is used in the print operation.

On the other hand, if the length $L_1$ of the long recording medium that can assure fixation of the toner image is smaller than the length $L_2$ of the long recording medium that is used in the input print operation, the amount of time that is required to supply electric power from the main power source to the main heating member 39A of the heating means 39 shown in FIG. 2 in order to completely fix the toner image on the long recording medium to be used in the print operation is calculated (S7 of FIG. 7). The warm-up period required to heat the fixing roller 36 until the print operation can be performed ($L_1 \geqq L_2$) is calculated.

Next, the warm-up period that is required until the print operation can be performed is displayed on the abovementioned display operating portion provided in the image forming apparatus main body or a display of a personal computer (not shown) connected to the image forming apparatus, and also display is performed so as to select whether to execute or stop the input operation (S8 of FIG. 7). The user confirms the warm-up period required until the print operation can be performed, and thereupon inputs whether to execute or stop the print operation. When the user executes a stop operation on the print operation (S9 of FIG. 7), the print operation is canceled (S10 of FIG. 7). When the user selects to execute the print operation, electric power is supplied from the main power source to the main heating member 39A until the print operation is executed, and this operation is continued if a warm-up operation of the fixing roller 36 is performed, but the warm-up operation is started if the warm-up operation is not performed (S11 of FIG. 7). Next, the step proceeds to S1 of FIG. 7 where the abovementioned operation is repeated. In this manner, the print operation is started in a state in which the toner image on the input long recording medium can be completely fixed, or a state in which the print operation can be performed (S5, S6).

As described above, the image forming apparatus of the present embodiment has the means for selecting whether to execute or stop print operation when the length $L_1$ of the recording medium at which fixation of the toner image can be assured is smaller than the length $L_2$ of the long recording medium that is used in the print operation. When execution of the print operation is selected, warm-up operation in which the fixing roller is heated by the heating means is executed.

Due to the configuration described above, the temperature of the fixing roller 36 is prevented from becoming lower than the temperature suitable for fixing a toner image during the operation of fixing the toner image on the long recording medium, and thereby the occurrence of a toner image fixation failure is prevented.

The above has described the fixing device having the fixing member configured by the fixing roller 36 and the pressure member configured by the pressure roller 37, and the present invention can be applied to a fixing device that has a fixing member configured by a fixing belt that is wrapped around a plurality of support rollers and thereby driven to travel, or a fixing device in which a pressure member is also configured as a pressure belt.

According to the present invention, the temperature of the fixing member is prevented from becoming lower than the temperature suitable for fixation during the operation of fixing a toner image onto a long recording medium, and thereby the occurrence of a toner image fixation failure can be prevented.

Various modifications will become possible for those skilled in the art after receiving the teachings of the present disclosure, without departing from the scope thereof.

What is claimed is:

1. An image forming apparatus which forms a toner image on an image carrier, transfers the toner image to a long recording medium longer than a regular size, and fixes the toner image transferred to the long recording medium by a fixing device, the fixing device comprising:

a fixing member;

a pressure member pressure-contacted with the fixing member thereby forming a nip between the fixing member and the pressure member;

a first temperature detecting device for detecting a temperature of the fixing member;

a second temperature detecting device for detecting a temperature of the pressure member;

a heater for heating the fixing member, wherein the heater includes:

a main heating member to which electric power is supplied from a main power source: and an auxiliary heating member to which electric power is supplied from an auxiliary power source, wherein when fixing the toner image by causing the long recording medium to pass through the nip formed between the fixing member and the pressure member while heating the fixing member by only the main heating member to which electric power is supplied from the main power source, if the temperature of the fixing member that is detected by the first temperature detecting device is equal to or lower than a fixation temperature threshold at which it is determined that a temperature required for toner image fixation cannot be maintained, the electric power is also supplied from the auxiliary power source to the auxiliary heating member to heat the fixing member:

a remaining amount detecting device that detects a remaining amount of electric power supplied from the auxiliary power source;

a calculating device that calculates the amount of accumulated heat of the fixing member and the pressure member from the temperature of the fixing member and the pressure member detected by the first and second temperature detecting devices;

a recording medium length calculating device that calculates a recording medium length at which fixation of the toner image onto the long recording medium can be assured, from the remaining amount of electric power supplied from the auxiliary power source, which is detected by the remaining amount detecting means, and the amount of accumulated heat;

a comparing device that compares the length of the long recording medium that is used in print operation when a print instruction is input, with the recording medium length at which fixation of the toner image at this time point can be assured; and a control device that starts the print operation only when the recording medium length at which fixation of the toner image can be assured is equal to or greater than the length of the long recording medium that is used in the print operation.

2. The image forming apparatus as claimed in claim 1, further comprising a selecting device that selects to execute or stop the print operation when the recording medium length at which fixation of the toner image can be assured is smaller than the length of the long recording medium that is used in the print operation, wherein when execution of the print operation is selected, warm-up operation for heating the fixing member by the heater is executed.

3. The image forming apparatus as claimed in claim 1, wherein the auxiliary power source is configured by an electric double layer capacitor capable of being charged and discharged and is configured so as to charge the electric double layer capacitor when electric power is not supplied from the main power source to the main heating member, while the remaining amount detecting means is configured by a voltage sensor device that detects voltage of the electric double layer capacitor.

4. The image forming apparatus as claimed in claim 1, wherein the auxiliary power source is configured by a fuel cell that can be repeatedly used by replacing fuel thereof.

5. The image forming apparatus as claimed in claim 4, wherein the fuel cell comprises a remaining amount detecting device that detects a remaining amount of fuel thereof, a display for displaying the remaining amount of fuel, and a prompting device that prompts replacement of the fuel when the remaining amount of fuel falls below a certain value, and the remaining amount detecting device detects the remaining amount of fuel.

6. An image forming method of forming a toner image on an image carrier, transferring the toner image to a long recording medium longer than a regular size, and fixing the toner image transferred to the long recording medium to the long recording medium, the method comprising:

preparing a fixing device that comprises a fixing member, a pressure member pressure-contacted with the fixing member, a first temperature detecting device for detecting a temperature of the fixing member, a second temperature detecting device for detecting a temperature of the pressure member, a main heating member to which electric power is supplied from a main power source, an auxiliary heating member to which electric power is supplied from an auxiliary power source, and a heating device for heating the fixing member;

causing the long recording medium carrying the toner image thereon to pass through a nip portion formed between the fixing member and the pressure member, and applying, at the time of the passage, heat and pressure to a toner of the toner image to fix the toner image onto the long recording medium;

calculating an amount of accumulated heat of the fixing member and the pressure member from the temperature of the fixing member and the pressure member detected by the first temperature detecting device and the second temperature detecting device;

supplying the electric power from the auxiliary power source to the auxiliary heating member to heat the fixing member by the auxiliary heating member as well, when fixing the toner image by causing the long recording medium to pass between the fixing member and the pressure member while heating the fixing member by only the main heating member to which electric power is supplied from the main power source, if the temperature of the fixing member that is detected by the first temperature detecting device is equal to or lower than a predetermined fixation temperature threshold at which it is determined that a temperature required for toner image fixation cannot be maintained;

detecting a remaining amount of electric power supplied from the auxiliary power source via a remaining amount detecting device;

calculating a recording medium length at which fixation of the toner image onto the long recording medium can be assured, from the remaining amount of electric power supplied from the auxiliary power source, which is detected by the remaining amount detecting device, and the amount of accumulated heat;

comparing the length of the long recording medium that is used in a print operation when a print instruction is input, with the recording medium length at which fixation of the toner image at this time point can be assured; and starting the print operation only when the recording medium length at which fixation of the toner image can be assured is equal to or greater than the length of the long recording medium that is used in the print operation.

7. The image forming method as claimed in claim 6, further comprising:

selecting to execute or stop the print operation when the recording medium length at which fixation of the toner image can be assured is smaller than the length of the long recording medium that is used in the print operation; and executing warm-up operation for heating the fixing member by the heating device when execution of the print operation is selected.

8. The image forming method as claimed in claim 6, wherein the auxiliary power source is configured by an electric double layer capacitor capable of being charged and discharged and is configured so as to charge the electric double layer capacitor when electric power is not supplied from the main power source to the main heating member.

9. The image forming method as claimed in claim 6, wherein the auxiliary power source is configured by a fuel cell that can be repeatedly used by replacing fuel thereof.

10. The image forming method as claimed in claim 9, further comprising:

detecting a remaining amount of fuel in the fuel cell;

displaying the remaining amount of fuel in the fuel cell, and prompting replacement of the fuel when the remaining amount of fuel falls below a certain value.

* * * * *